US007535325B2

(12) United States Patent
Mueller-Fiedler et al.

(10) Patent No.: US 7,535,325 B2
(45) Date of Patent: May 19, 2009

(54) COMPONENT FOR IMPEDANCE CHANGE IN A COPLANAR WAVEGUIDE AND METHOD FOR PRODUCING A COMPONENT

(75) Inventors: Roland Mueller-Fiedler, Leonberg (DE); Markus Ulm, Stutensee (DE); Mathias Reimann, Reutlingen (DE); Thomas Buck, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 231 days.

(21) Appl. No.: 10/572,220

(22) PCT Filed: Jul. 24, 2004

(86) PCT No.: PCT/DE2004/001658

§ 371 (c)(1),
(2), (4) Date: Mar. 16, 2007

(87) PCT Pub. No.: WO2005/036580

PCT Pub. Date: Apr. 21, 2005

(65) Prior Publication Data

US 2007/0229198 A1 Oct. 4, 2007

(30) Foreign Application Priority Data

Sep. 17, 2003 (DE) ..... 103 42 938

(51) Int. Cl.
*H01P 1/10* (2006.01)
*H01H 59/00* (2006.01)

(52) U.S. Cl. ..... 333/262; 333/105

(58) Field of Classification Search ..... 333/262, 333/101, 104, 105; 200/181
See application file for complete search history.

(56) References Cited

U.S. PATENT DOCUMENTS 6,686,810 B2 * 2/2004 Mueller-Fiedler et al. ..... 333/33

(Continued)

FOREIGN PATENT DOCUMENTS

DE 100 37 785 7/2001

OTHER PUBLICATIONS

Jung-Mu Kim et al.: "A 5-17 ghz wideband reflection-type phase shifter using digitally operated capacitive mems switches" 12th Int. Conf. on Solid State Sensors, Bd. 1, Jun. 9, 2003, pp. 907-910, XP010646855 Boston.

(Continued)

*Primary Examiner*—Dean O Takaoka
(74) *Attorney, Agent, or Firm*—Kenyon & Kenyon LLP

(57) ABSTRACT

A component is provided for an impedance change in a coplanar waveguide which includes two grounding conductors and a signal line lying between the grounding conductors, as well as a conducting connecting element, which has a covering surface for the two grounding conductors and the signal line, and is electrically insulated, so that in each case a capacitor is formed. The connecting element and the lines are situated and arranged so that the respective capacitor between the grounding conductors and the connecting element has an invariable capacitance, but the capacitor between the connecting element and the signal line has a variable capacitance. A structure is also provided in which in an exactly opposite way, the respective capacitor between the grounding conductors and the connecting element has a variable capacitance, but the capacitor between the connecting element and the signal line has an invariable capacitance. Furthermore, a method for producing such a component is also provided.

16 Claims, 16 Drawing Sheets

U.S. PATENT DOCUMENTS 6,713,695 B2 * 3/2004 Kawai et al. ..... 200/181
6,882,255 B2 * 4/2005 Mueller-Fiedler et al. ... 333/262

OTHER PUBLICATIONS

Rose J. et al.: Development of a MEMS microwave switch and application to adaptive integrated antennas: CCECE 2003. Canadian Conference on Electrical and Computer Enginnering. Montreal, Canada, May 4-7, 2003, Canadian Conference on Electrical and Computer Engineering, New York, N.Y.: IEEE, US, Bd. vol. 3 of 3, May 4, 2003 pp. 1901-1904, XP 010654017, ISBN: 0-7803-7781-8, the whole document.

Hong-Teuk Kim et al.: "A new micromachined overlap CPW structure with low attenuation over wide impedance ranges" Microwave Symposium Digest. 2000 IEEE, MTT-S International Boston, MA, USA Jun. 11-16, 2000, Piscataway, NJ, USA, IEEE, US, Jun. 11, 2000, pp. 299-302, XP010505978, ISGN: 0-7803-5687-X, the whole document.

Yoshida y et al.: "A grounded coplanar waveguide with a metallized silicon cavity fabricated by front-surface-only processes", Sensors and Actuators A, Elsevier Sequoia s.a., Lausanne, CH. Gd. 111, Nr. 1, Mar. 1, 2004, pp. 129-134, XP004489333, ISSN: 0924-4247, the whole document.

Huang J.-M. et al.: "Mechanical design and optimization of capacitive micromachined switch", Sensors and Actuators A., Elsevier Sequoia s.a., Lausanne, CH, Bd. 93, Nr. 3, Oct. 15, 2001, pp. 273-285, XP004298781, ISSN: 0924-4247, the whole document.

* cited by examiner

COMPONENT FOR IMPEDANCE CHANGE IN A COPLANAR WAVEGUIDE AND METHOD FOR PRODUCING A COMPONENT

FIELD OF THE INVENTION

The present invention relates to a component as well as a method for producing a component for impedance change in a coplanar waveguide.

BACKGROUND INFORMATION

Components and production methods for components for impedance change in coplanar waveguides have become known in various specific embodiments.

In one specific embodiment of a micromechanically produced high-frequency short-circuiting switch, a thin metal bridge is stretched between grounding conductors of a coplanar waveguide. This bridge is electrostatically drawn to a thin dielectric disposed on a signal line lying between the ground elements, thereby increasing the capacitance of a "plate-type capacitor" formed by the bridge and the signal line. This capacitance change influences the propagation properties of the electromagnetic waves guided on the waveguide. In the "off" state (the metal bridge is pulled downwards to the signal line) a major part of the power is to be reflected. In the "on" state, however, (the metal bridge is above), a large part of the power is transmitted.

In German Laid-Open Document DE 100 37 785 A1, a device for impedance change on a coplanar waveguide is discussed, in which the grounding conductors are connected by a connecting piece and the signal line has a bridge, at the location of the connecting piece, which, in turn, may be operated electrostatically. The advantage of this specific embodiment is that the length of the metal bridge, that is, the length of the bridge over the element connecting the grounding conductors, is not a function of the clearance between the grounding conductors of the coplanar waveguide. Accordingly, the clearance between the grounding conductors of the waveguide may be selected independently of the length of the bridge, and vice versa, A disadvantage of both the mentioned specific embodiments is that, for the electrostatic operation of the respective bridge, the grounding conductors and the signal line have to have a direct current control voltage applied to them.

One structure from the related art that does not have this disadvantage is shown in FIGS. 5*a* and 5*b* of the attached drawings. FIG. 6 shows, in addition, a greatly schematized equivalent circuit diagram for this structure. Component 101, illustrated in FIGS. 5*a* and 5*b*, for impedance change of a section of a waveguide 102 includes two external grounding conductors 103, 104 and a signal line 105 lying between them. A bridge arrangement 106 having a self-supporting bridge 107 is constructed over grounding conductors 103 and 104, as well as signal line 105. A section along section line V-V, having a nondeflected bridge 107 and a deflected bridge 107 (drawn in broken lines) is illustrated in FIG. 5*b*. Bridge 107 is stretched between vertical member elements 108 that are electroplated on at each end.

In order to obtain a compact structure, each grounding conductor 103 and 104 has a recess 103*a* or 104*a* in the vicinity of bridge 107.0

The bridge, via a connection 109, may have applied to it a control dc voltage with respect to lines 103, 104, 105, in order to draw the bridge against lines 103, 104, 105 via electrostatic forces. To avoid a short circuit, in the vicinity below the bridge, an insulating layer 110 is laid over lines 103, 104, 105 (for this, see especially the sectional arrangement).

Component 101 may be described by an equivalent circuit diagram according to FIG. 6, with a view to its high frequency properties. Symmetrical to two line sections 111, 112 with symbolically shown characteristic wave resistance 113, a grounded branch 114 branches off, which has the following components: A first mutual capacitance 115, an inductance 116 and an ohmic resistance 117, followed by a second mutual capacitance 118. Before the second mutual capacitance, a voltage source 119 is symbolically connected.

First mutual capacitance 115 is defined by the intersection of signal line 105 and 107, and may assume, in particular, two capacitance values according to the two positions shown in FIG. 5*b*. Inductance 116 comes about from the bridge sections between signal line 105 and respective grounding conductor 103, 104. The same sections define ohmic resistance 117. Mutual capacitance 118 is established by the intersection of bridge 107 with the respective narrow region of grounding conductors 103 or 104, and may also, just as first mutual capacitance 114, in particular, assume two values corresponding to the positions of bridge 107 shown in FIG. 5*b*. Using such a construction, one may achieve, for example, a capacitance change by approximately a factor of 100, whereby component 101 may be used in a prespecified frequency range as a high frequency switch.

In principle, using this construction, a decoupling of the control signal of the switchable capacitances of lines 103, 104, 105 is implemented, and thereby the possibility is given of using such switching elements in change-over switches, distribution networks or phase shifters.

However, it has turned out that such a bridge, having uniformly reproducible switching properties, is not simple to implement, if it can be done at all.

SUMMARY OF THE INVENTION

The exemplary embodiment and/or exemplary method of the present invention is based on the object of making available a component described above, having mutual capacitances decoupled with regard to the control signal, which has improved switching parameters.

This object is attained by the features described herein.

Advantageous and expedient embodiments for implementing the present invention are specified in the dependent claims.

First of all, the exemplary embodiment and/or exemplary method of the present invention relates to a component for impedance change in a coplanar waveguide, which includes two grounding conductors and a signal line that lies between the grounding conductors, as well as a conducting connecting element which has a covering surface (area) for the two grounding conductors and the signal line, and is insulated, so that, in each case, a capacitor is formed. Now, an aspect of the exemplary embodiment and/or exemplary method of the present invention is that the connecting element and the conductors are positioned and designed in such a way that the respective capacitor between the grounding conductors and the connecting element has an invariable capacitance, but the capacitor between the connecting element and the signal line has a variable capacitance. This procedure is based on the knowledge that it is very difficult, in the case of the exemplary embodiment and/or exemplary method that was last mentioned above, to get the switchable bridge to lie reproducibly upon the grounding conductors in a planar manner on the outside, that is, in FIG. 5*b*, in the area of vertical member elements 108 in the activated state. This disadvantage may be avoided by executing the mutual capacitance to the grounding conductors as an invariable capacitor. This may be achieved especially in that vertical member elements 108 shown in FIG. 5*b* are shifted into an area above insulated grounding conductors 103, 104. Because of this procedure, one only has to make certain that bridge 107 lies reproducibly in a planar manner on the insulating layer above signal line 105.

However, in an alternative specific embodiment, it is conceivable with the same advantages that the mutual capacitance is designed to be invariable to the signal line but the mutual capacitances to the respective grounding conductors is designed to be variable.

In both cases, the mutual capacitances lie in series with an inductance and form a resonant circuit, whose resonant frequency, because of the variable capacitance or capacitances, is able to reflect (mirror) two working points, e.g. transmission and reflection of a signal having a prespecified frequency. For the desired function of the resonant circuit, it is thus sufficient if a mutual capacitance is switchable.

In one embodiment of the present invention, the connecting element is able to be deformed mechanically, which may be elastically, in such a way that the distance between the connecting element and the line that, together with the connecting element, forms the variable capacitance, is variable in the area of the covering surface, for instance, via electrostatic forces.

However, it is also possible that the signal line or the grounding conductors, in a subsection, in which it(they) cover(s) the connecting element, is(are) at a distance mechanically deformable in such a way that the distance may be adjusted in the area of the respective cover surface. Consequently, in this specific embodiment, the grounding conductors are not connected by a bridge, but a bridge is provided, for instance, in the signal line, under which the connecting element runs, the connecting element being coupled by covering surfaces with the grounding conductors and at least one insulating layer intercalated in between, in a fixed capacitive manner, to the grounding conductors. Consequently, this variant has the advantage that the bridge may be designed independently of the clearance from the grounding conductors, and, at the same time, the capacitive coupling between grounding conductors and signal lines may be switched at a comparatively greater reproducibility.

For the switching of the variable capacitor, the connecting element may have a voltage applied to it. With that, electrostatic forces on the capacitor may, for example, be used between the connecting element and the signal line, in order to be able to switch over its capacitance, for instance, between two values.

In a method for producing the components just described, for impedance change in a coplanar waveguide, which includes two grounding conductors and a signal line that lies between the grounding conductors, as well as a conducting connecting element which has an overlapping surface to the two grounding conductors and the signal line, and is insulated, so that, in each case, a capacitor is formed, the major aspect is in the following method steps:

One or more conductive layers are deposited on the substrate for developing the connecting element, and are subsequently patterned, which may be by photolithographic methods. Then an insulating layer is deposited, and, on the insulating layer, the grounding conductors as well as the signal lines are built up with a bridge over the connecting element. By this method one obtains a component in which the connecting element is coupled via capacitors having a fixed capacitance to the grounding conductors and to the signal line via a capacitor that is variable in its capacitance, which, however, may be switched at comparatively good reproducibility.

If a not highly insulated substrate is used, it is additionally advantageous if an insulating layer is first generated on the substrate, before building up the structure. This may be done, for instance by thermal oxidation or by applying a PECVD layer (PECVD stands for plasma-enhanced chemical vapor deposition). Thermal oxide is advantageous with regard to a low damping of a high frequency signal.

Furthermore, the insulating layer deposited on the connecting element may be patterned. In this way, not only a terminal for the connection of the connecting element is able to be exposed, but possibly also areas on connecting bars which are used for later electroplating for the electrical connection of sections on which structures are to be "electroplated on".

The grounding conductors and at least a part of the signal lines may be generated via an electroplating step. For this it is advantageous if a starting layer is deposited first. This starting layer is favorably patterned via a lift-off process. Thereby it is avoided that damage occurs in the dielectric that has already been applied to the connecting element. In addition, one does not have to notice whether the starting layer is able to be patterned selectively from the material of which the connecting element is made.

For the further construction of the lines with a bridge over the connecting element in the area of the signal line, it is advantageous if a sacrificial layer is applied and patterned. In this context, the area of the subsequent bridge is also covered by the sacrificial layer. Now, in one electroplating step, each exposed area of the sacrificial layer may be reinforced with electroplating if, in addition, a starting layer is present in this area. One may permit the galvanic layer to grow to the extent that it overlaps over the sacrificial layer, and, in cross section, so to speak, a mushroom structure is created.

Now, in one additional step, an additional metallization is laid down and patterned, over the sacrificial layer, using electroplating reinforcement. Hereby is created, in the first place, the bridge of the signal line, the remaining areas, may be formed, in a top view, corresponding to the contour of the signal line and the grounding conductors. The sacrificial layer is subsequently removed thereafter, which may be anisotropically, down to the area under the bridge.

Subsequently to these measures, in a subsequent step, for instance, connecting crosspieces for the electroplating step may be removed, without running the risk of damaging the bridge. Such connecting crosspieces are required in order, in the electroplating step, to connect electrically to one another all areas in which an electroplating structure is to grow on a starting layer.

Finally, the sacrificial layer is also removed under the bridge metallization, whereby a component is created that is made up of essentially one coplanar waveguide, in which the grounding conductors are capacitively coupled in each case via a continuous connecting element, and the signal line is also capacitively coupled to the connecting element via a flexible bridge, that is, a switchable bridge. Thereby the impedance may be changed at this place, by applying a control voltage to the insulated connecting element, which results in electrostatic forced on the bridge at a corresponding shift in the position of the bridge.

The effect is a capacitance change, which will be explained further below, in connection with the exemplary embodiments, with reference to an equivalent circuit diagram of such a structure.

BRIEF DESCRIPTION OF THE DRAWINGS

FIG. 4*a* to 4*l* show different processing states in the production of a high frequency switch according to FIGS. 1*a* and 1*b*, in each case in a schematic, perspective representation.

DETAILED DESCRIPTION

Figure 1A:
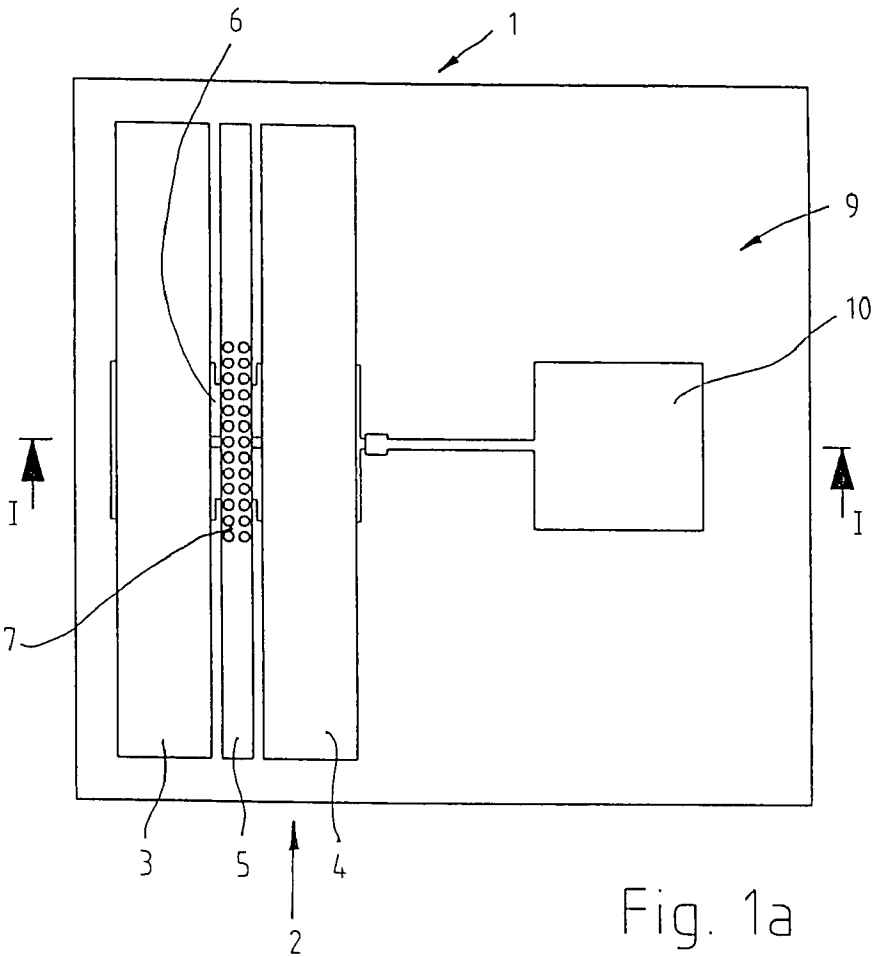
FIG. 1*a* shows a schematic representation, in which a first HF switching element having integrated control voltage decoupling in a top view (FIG. 1*a*).

FIG. 1*a* shows a high frequency switch 1, which includes a piece of a coplanar waveguide 2. Waveguide 2 has two grounding conductors 3, 4 as well as a signal line 5. Signal line 5 is designed in a region above a connecting element 6 in the form of a bridge 7 (see especially sectional view according to FIG. 1*a*). High frequency switch 1 is built up on a substrate 8, on which an insulating layer 9 was first deposited. Thereupon follows connecting element 6 having a connecting pad 10. Except for one contact place for connecting pad 10, connecting element 6 is covered by an additional insulating layer 11. Then there follows, in the structure of coplanar wave guide 2, a starting layer 12 for respective grounding conductor 3, 4 and signal line 5 (not to be seen in the section of FIG. 1*b*), a comparatively thick layer 13, which was reinforced galvanically and a cover layer 14, of which bridge 7 is also formed.

Now, if, via terminal pad 10, a voltage is applied to connecting element 6, electrostatic forces act on bridge 7, which, in terms of direct current, is at ground potential, which draw bridge 7 to connecting element 6 until bridge 7 lies on insulating layer 11 in the area over connecting element 6.

Figure 3:
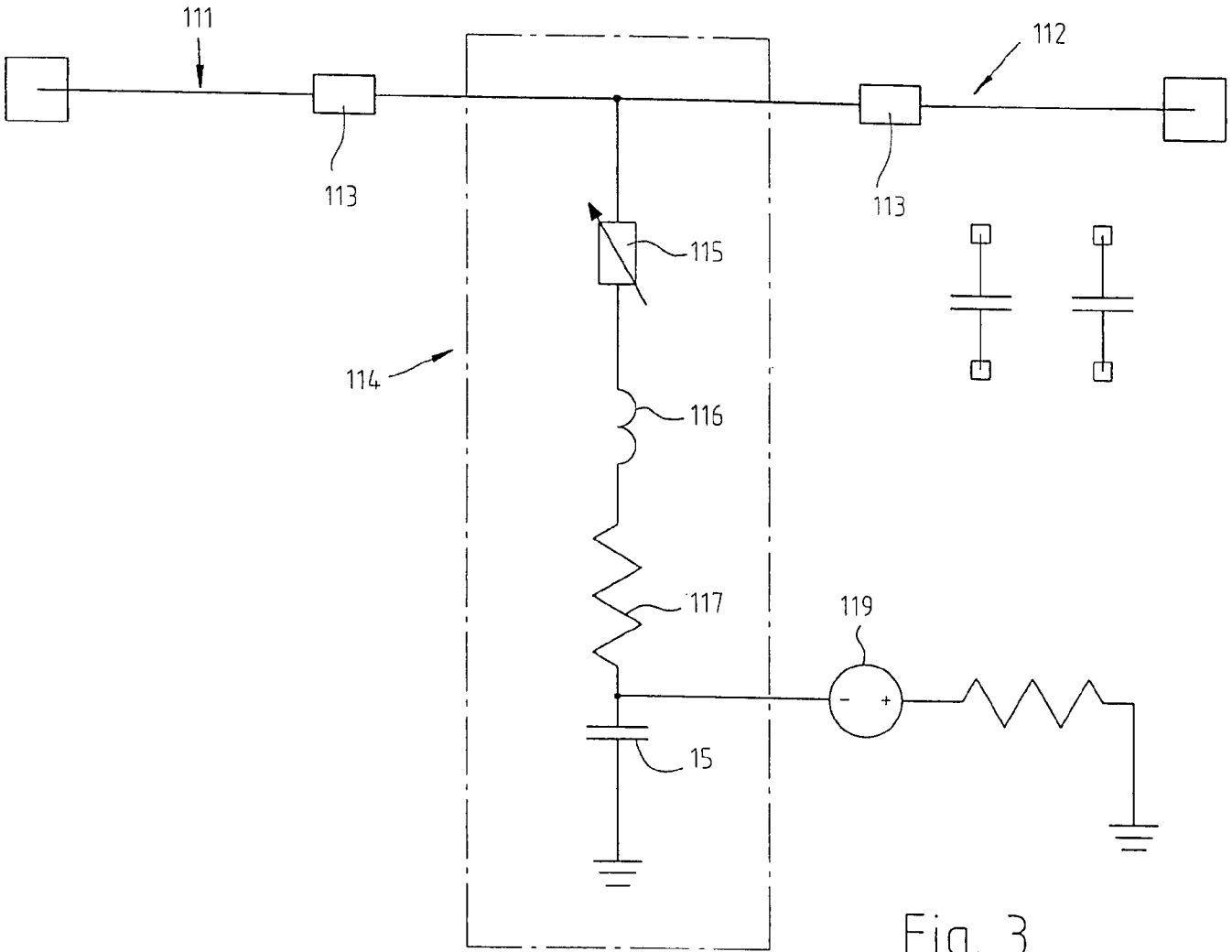
FIG. 3 an equivalent circuit diagram which applies to both high frequency switches as in FIGS. 1*a* and 1*b*, or FIGS. 2*a* and 2*b*.

The appertaining electrical equivalent circuit diagram is explained in the light of FIG. 3. In this context, the same reference numerals were used as in FIG. 6, except for the second mutual capacitance, which in FIG. 6 has the reference numeral 118, since in this respect the electrical equivalent circuit diagram does not differ. In FIG. 3, the second mutual capacitance is given reference numeral 15.

Figure 1B:
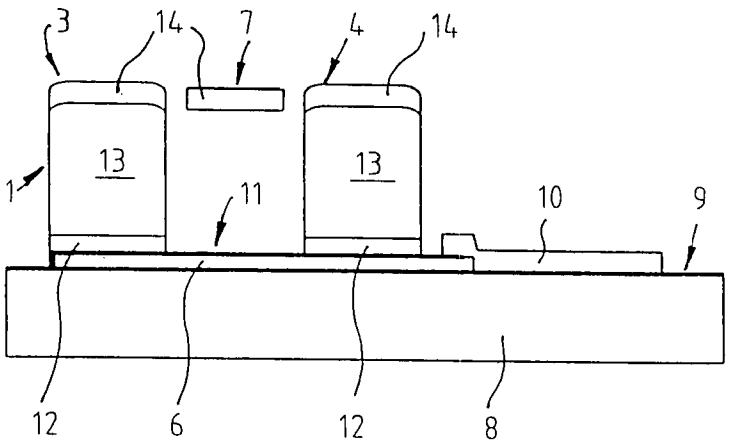
FIG. 1*b* shows a schematic representation, in which a first HF switching element having integrated control voltage decoupling in a section along cutting line I-I in FIG. 1*a*.
Figure 5B:
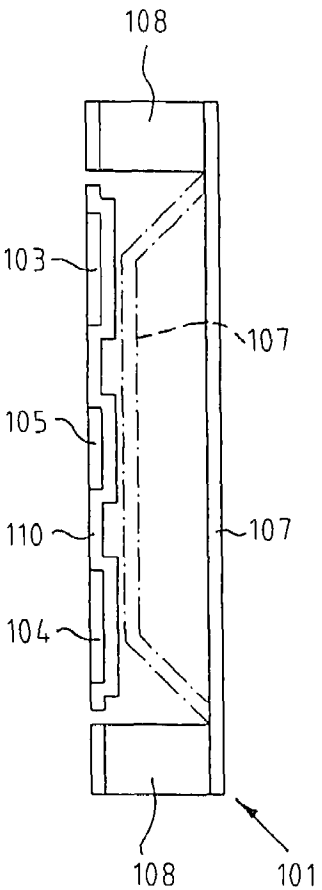
FIG. 5*b* shows a high frequency switch in a section along cutting line V-V of FIG. 5*a*, which is available from the related art.
Figure 5A:
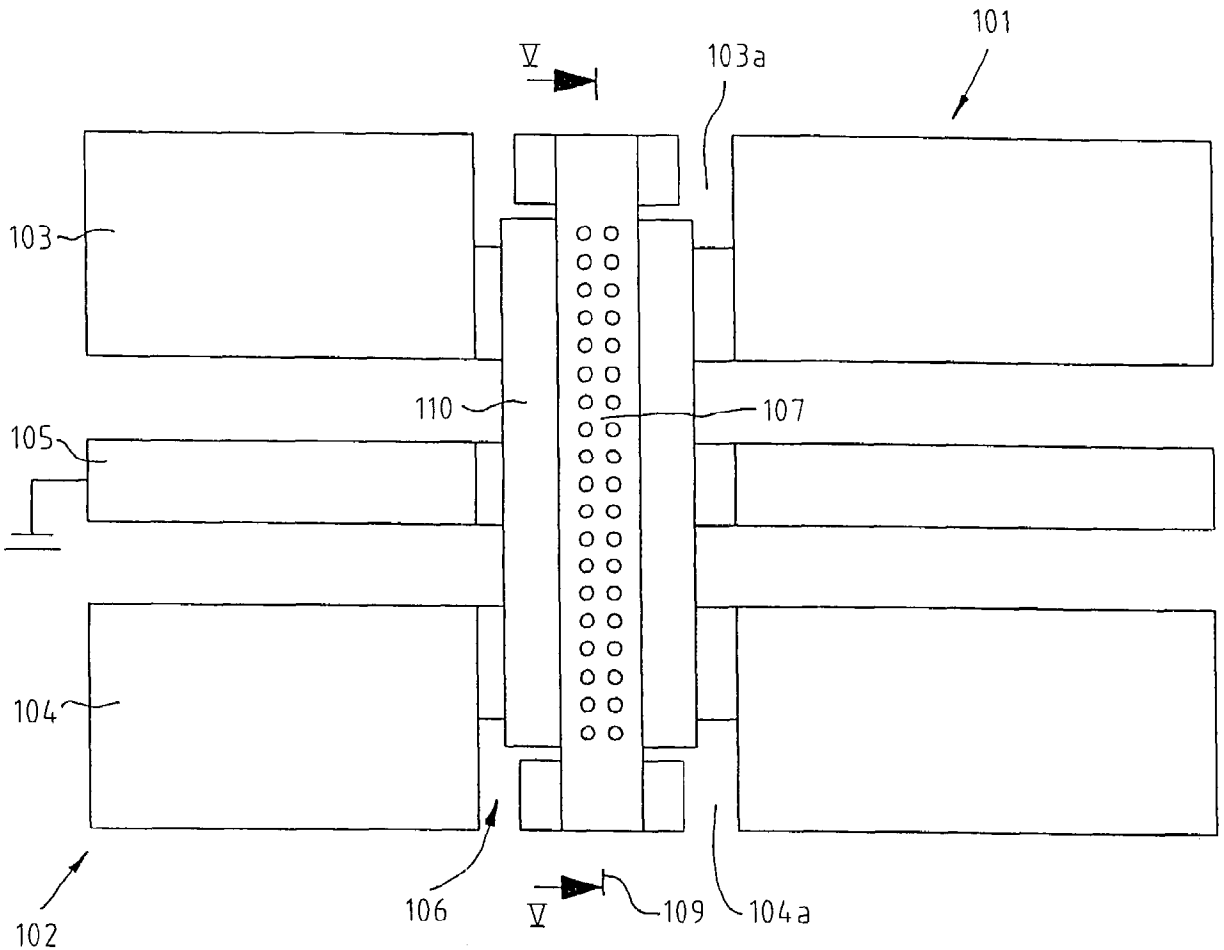
FIG. 5*a* shows a high frequency switch in a top view, which is available from the related art.
Figure 6:
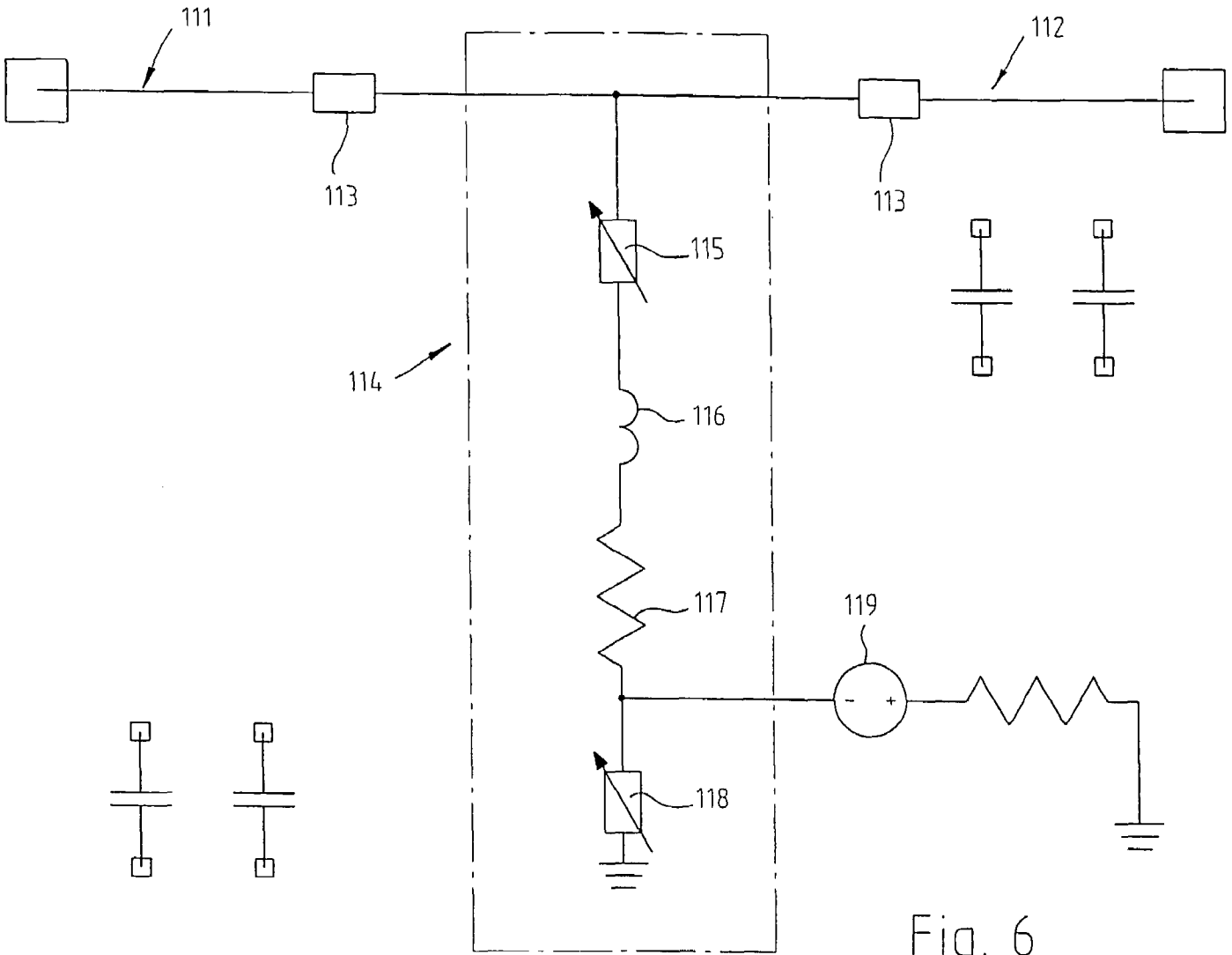
FIG. 6 shows an electrical equivalent circuit diagram for the high frequency switch, according to FIGS. 5*a* and 5*b*.

By contrast to the exemplary embodiment and/or exemplary method according to FIG. 6 or FIGS. 5*a* and 5*b*, second mutual capacitance 15 is fixed in its capacitance. In FIGS. 1*a* and 1*b* this corresponds to the intersection of connecting element 6 with grounding conductors 3, 4. Inductors 116 and ohmic resistors 115, for the range of the connecting element, are between signal line 5 and respective grounding conductors 3, 4. The variable mutual capacitance is established by the intersection of bridge 7 with connecting element 6. During activation via pad 10 in FIGS. 1*a* and 1*b*, one may set, for example, two values, one maximum value and one minimum value of the capacitance. In the equivalent circuit diagram, voltage source 119 is responsible for the electrostatic activation of bridge 7.

Figure 2A:
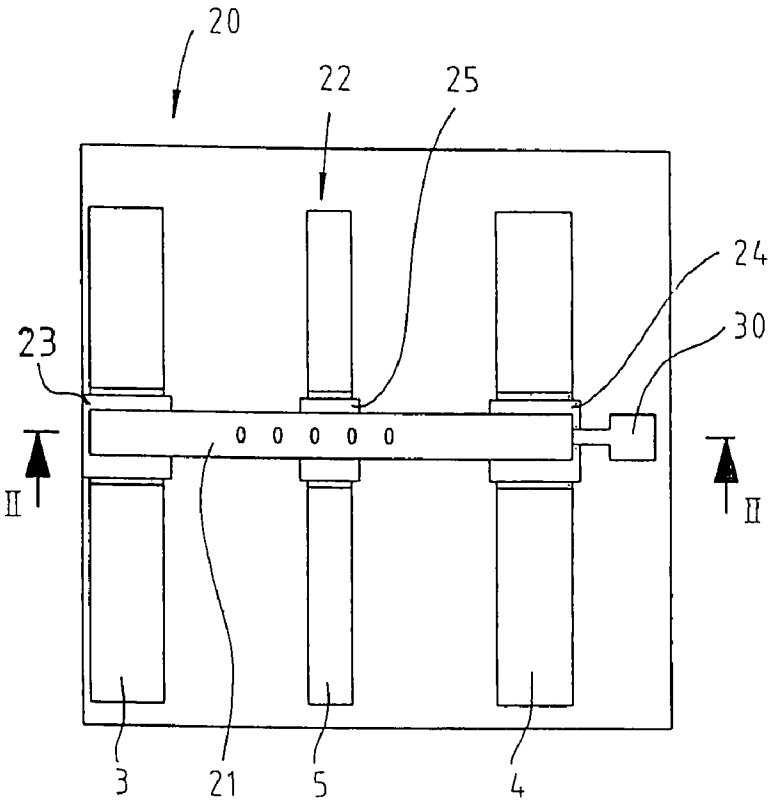
FIG. 2*a* shows an additional high frequency switch in a corresponding view.
Figure 2B:
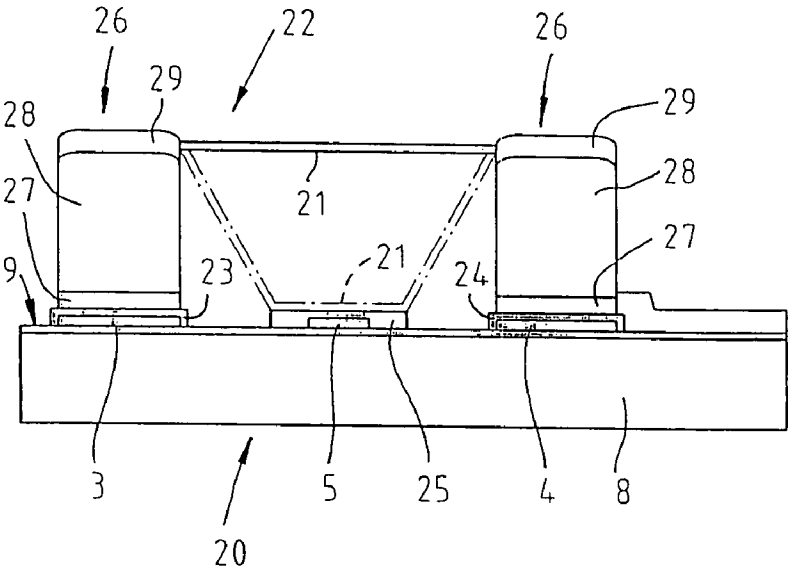
FIG. 2*b* shows an additional high frequency switch in another corresponding view.

The equivalent circuit diagram as in FIG. 3 comes about also for a high frequency switch according to FIGS. 2*a* and 2*b*. However, the high frequency switch according to FIGS. 2*a* and 2*b* differs quite substantially from the high frequency switch according to FIGS. 1*a* and 1*b* in that, instead of a longitudinal bridge along signal line 5, in FIG. 2 a lateral bridge 21 is implemented between grounding conductors 3, 4.

In order to make this possible, high frequency switch 20 has the following construction: On substrate 8 having insulating layer 9, at first there is not a connecting element, but the line structures of coplanar waveguide 22 having grounding conductors 3, 4 and signal line 5. In the vicinity of bridge 21, in each case an insulating layer 23, 24, 25 is provided. This is followed by a vertical member element 26, in each case on outside grounding conductor 3, 4. Vertical member elements 26 have three layers, as seen in section: First a starting layer 27, followed by a galvanically grown layer 28, and covered by a cover layer 29 which, from an electrical point of view, corresponds to connecting element 6, and from which bridge 21 is formed. Vertical member structure 26 along with bridge 21 may be acted upon with a control voltage via a contact pad 30.

What applies for both principles according to FIGS. 1 and 2 is that mutual capacitance 15 (formed from the respective mutual capacitances of connecting element 6 and vertical member element 26) is connected in series with the actual switching capacity 115, inductance 117 and ohmic resistance 116, and therewith forms a resonant circuit. If mutual capacitance 15 is selected to be large, compared to switching capacity 115 in the controlled, that is, lower state of respective bridge 7, 21, then, with respect to a resonant frequency of the resonant circuit, the switch behaves like a corresponding switch without integrated control dc voltage decoupling. But if one reduces mutual capacitance 15, one then obtains an additional degree of freedom for the purpose of shifting the resonant frequency of the resonant circuit towards higher frequencies. Furthermore, because of that, in the non-controlled state, one may reduce the capacitance effective for the high frequency, and thereby particularly also the insertion attenuation, without this going along with an increase in the switching voltage. The attracting force for the bridge comes about from the derivation of the energy stored in the capacitor, with which constant mutual capacitances 15 have nothing to do in this regard.

For a high frequency switch according to FIGS. 2*a* and 2*b* there is further the advantage that the length of bridge 21 may be changed independently of the coplanar line geometry by the position of vertical member 26. This is very important, since in that way a mechanical switching voltage and an inductance may be simply varied. In addition, specific embodiments according to FIGS. 2*a* and 2*b* also become possible for higher frequencies which, in order to avoid parasitic modes, require very small signal line widths.

FIGS. 4*a* to 4*l* are intended to clarify the production of a high frequency switch 1 according to FIGS. 1*a* and 1*b*. According to FIG. 4*a*, the starting point is, for example, a high ohmic, p-doped silicon substrate 8 having a thickness of 300 μm. For the insulation of a high frequency component built up onto this, substrate 8 may be thermally oxidized to generate an insulating layer 9. Up to now, a PECVD layer has a higher damping.

Subsequently, (see FIG. 4*c*) a layer of molybdenum-tantalum (MoTa) is applied in a thickness which may be 100 to 400 nm, using a sputtering process. Other metallizing processes are possible too, however, a refractory metal, such as molybdenum-tantalum, should be used. In addition to which, molybdenum-tantalum is comparatively non-noble, and is able to be etched wet-chemically, at the end of the process sequence, selectively with respect to all other metals used. This is especially important for connecting bar 40 for carrying out the electroplating.

In order to lower the comparatively high resistance of molybdenum-tantalum, especially for the area of the connection between the mutual capacitances, aluminum or a multilayer system made of aluminum and molybdenum-tantalum may also be used instead.

In any case, the applied layer is patterned, in order to generate from it connecting element 6. In the area of later grounding conductors 3, 4, this is made of an area 41 having a predefined size, in order to specify fixed mutual capacitance 15, of narrow connecting crosspieces 42 to a middle electrode area, by which the coupling to the later signal line is established.

After that, an insulating layer, e.g. PECVD $SiO_x$ is depositied, for example at 300° (C). Instead of PECVD $SiO_x$, silicon oxynitride (SiON), silicon nitride ($Si_3N_4$) or another insulator may be used. The insulating layer is also patterned, especially in the area of the connecting bars as well as at a connecting place 43 for a later connecting pad 10 for having a control voltage act upon the high frequency component (see FIG. 4*d*).

Figure 4A:
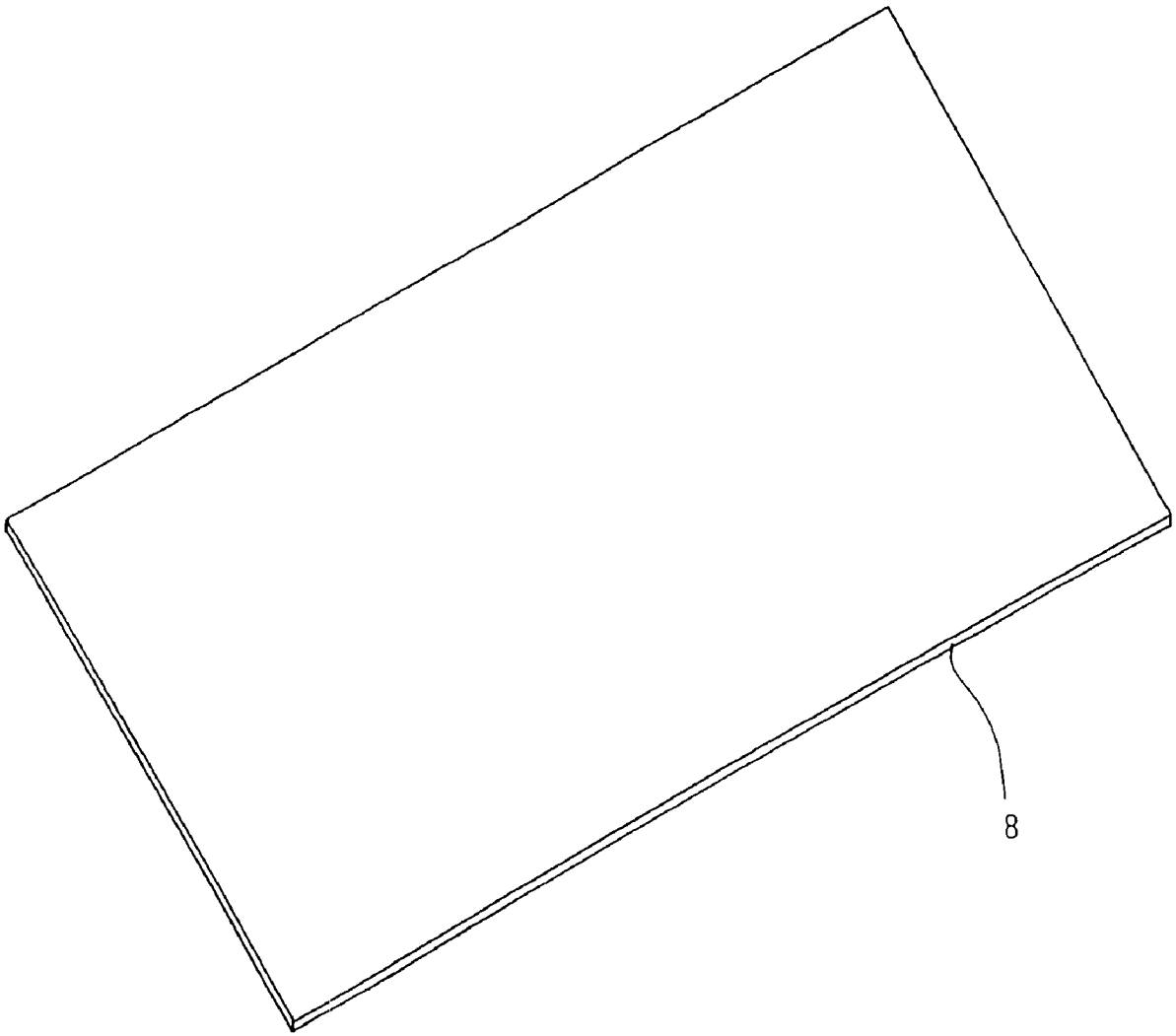
Figure 4B:
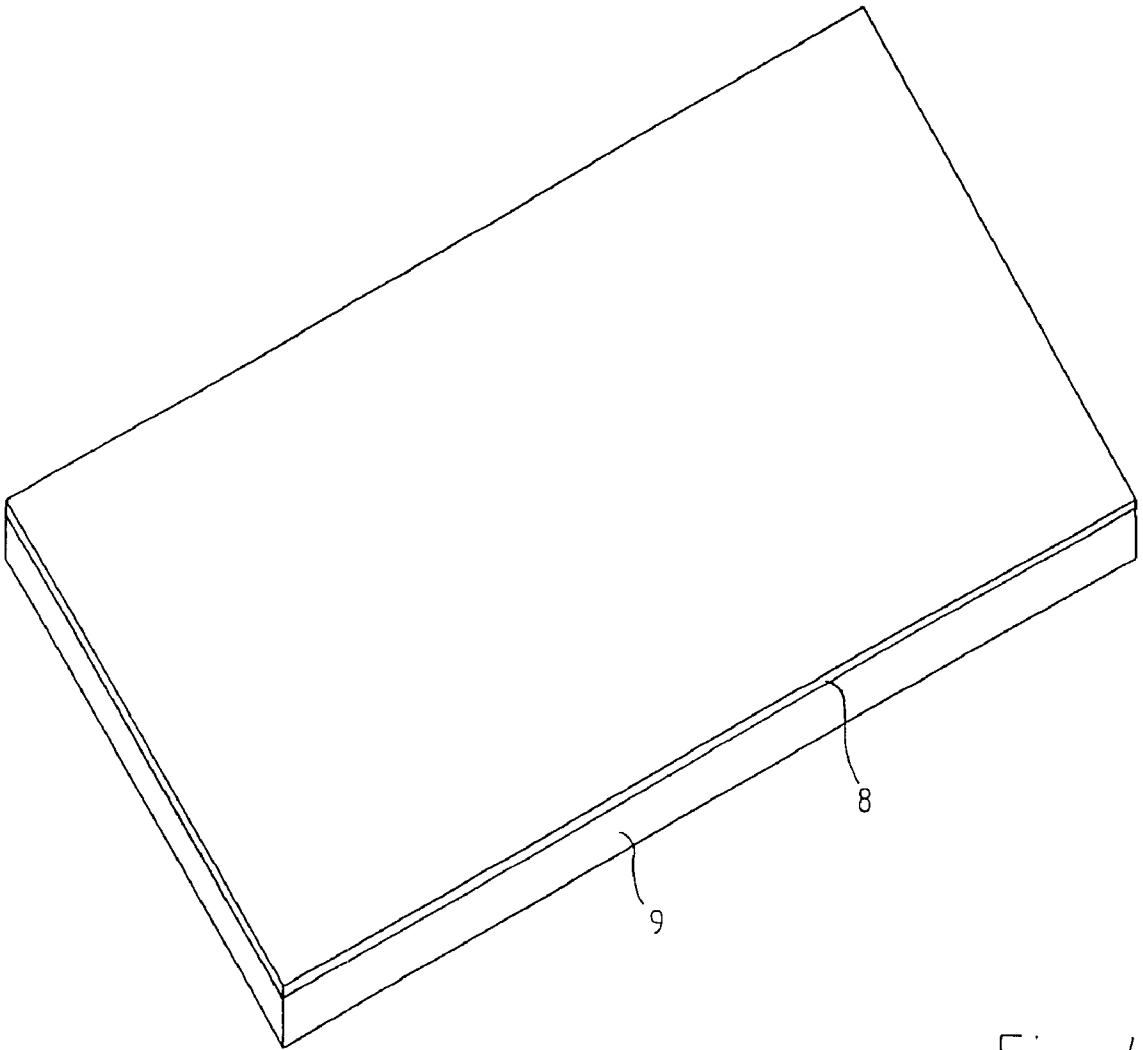
Figure 4C:
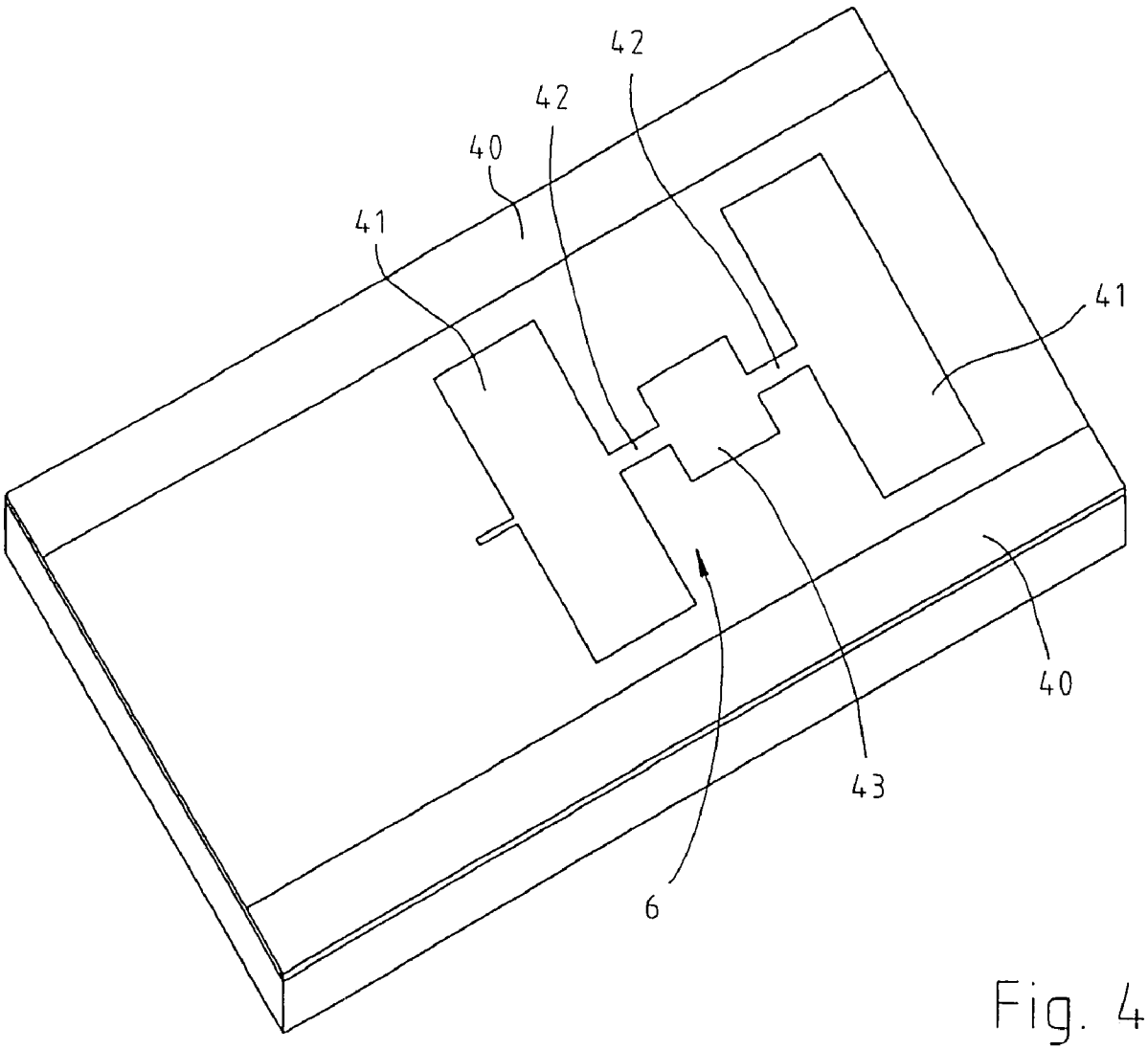
Figure 4D:
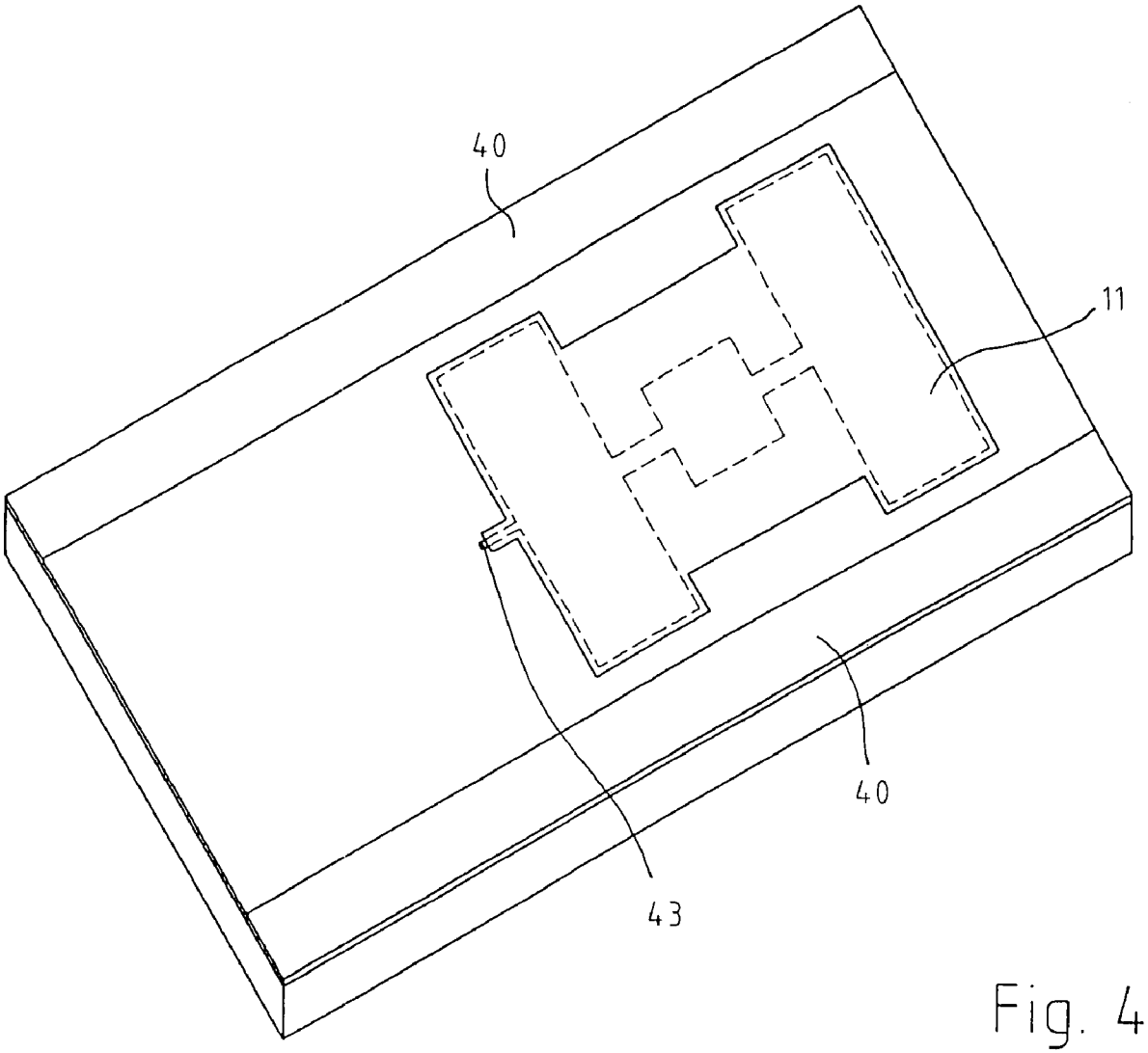
Figure 4E:
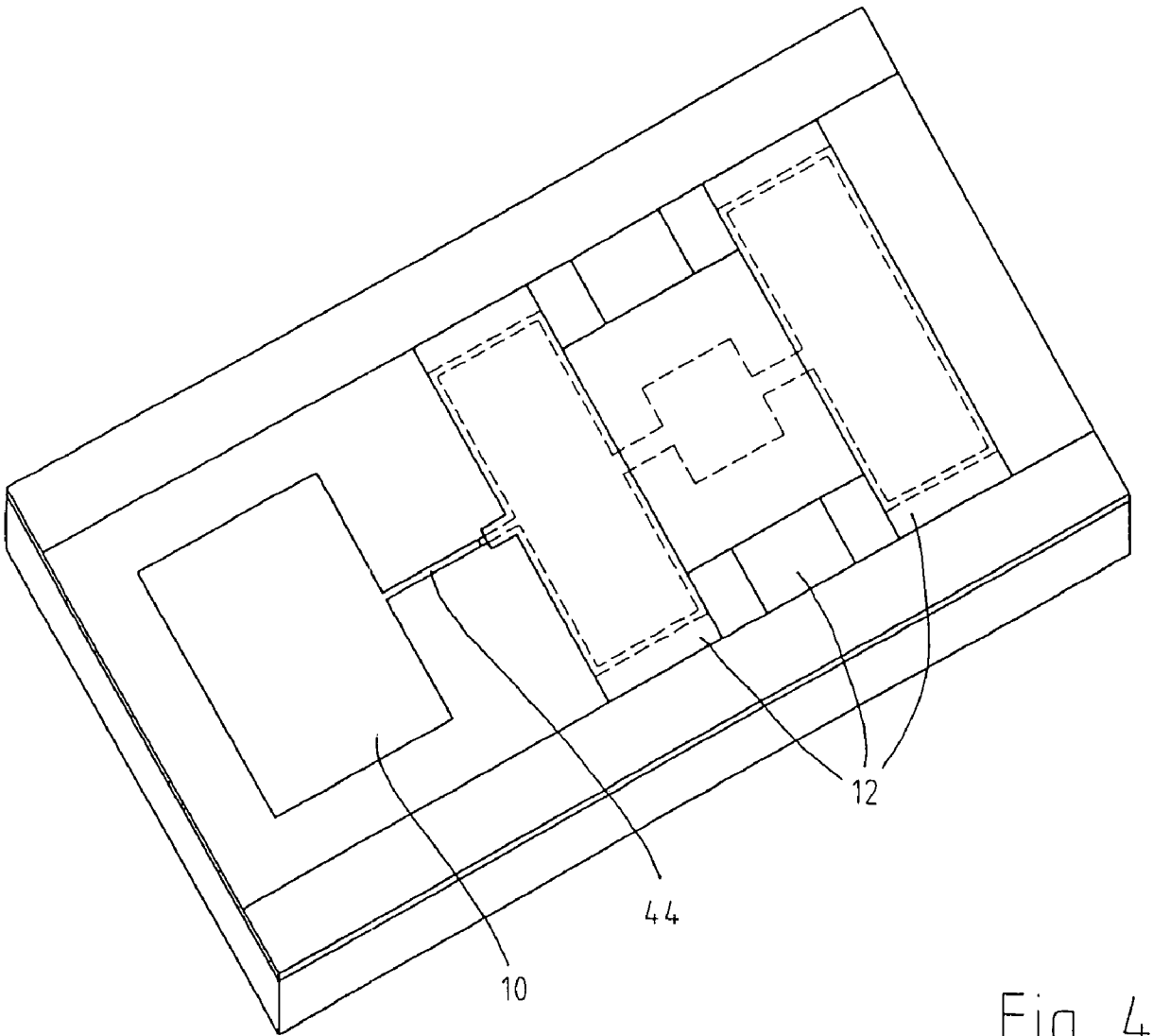

According to FIG. 4*e*, onto this layer sequence, a starting metallization layer 12 may be sputtered on, for instance, at a thickness of 300 nm (titanium-tungsten, gold or chromium-copper coming into consideration as the metals) and patterned in the shape of the intended waveguide structure, with regard to the grounding conductor and the signal line, which may be by a lift-off process. By the use of the lift-off process, previously applied insulating layer 11 is not affected. With regard to the structure of the signal line, one should note that this is interrupted in the area of electrode 43 (at this location there will follow the later connection by bridge 7 situated above it).

Besides that, using the starting metallization, supply line 44 to connecting pad 10 is generated.

Figure 4F:
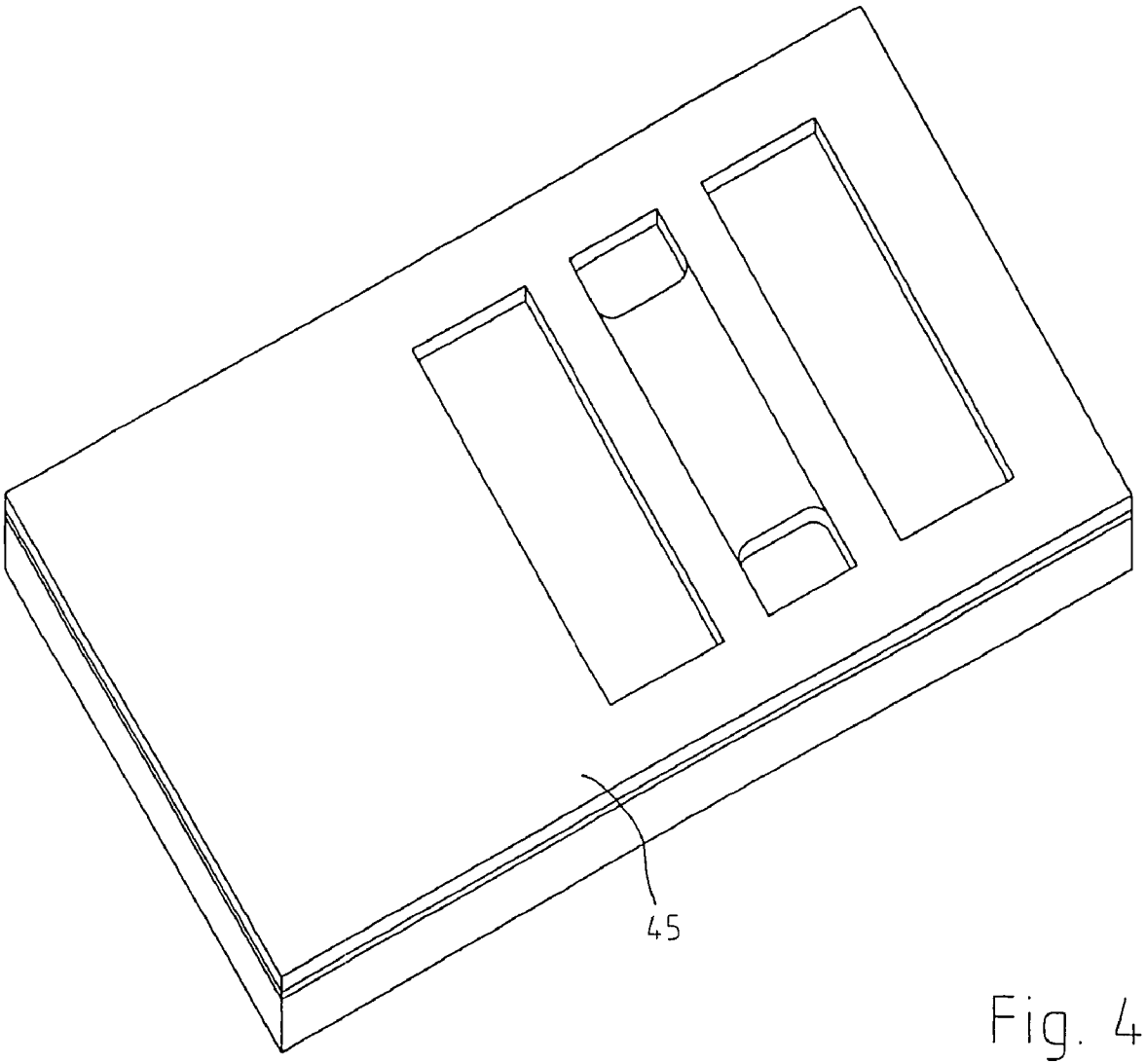
Figure 4G:
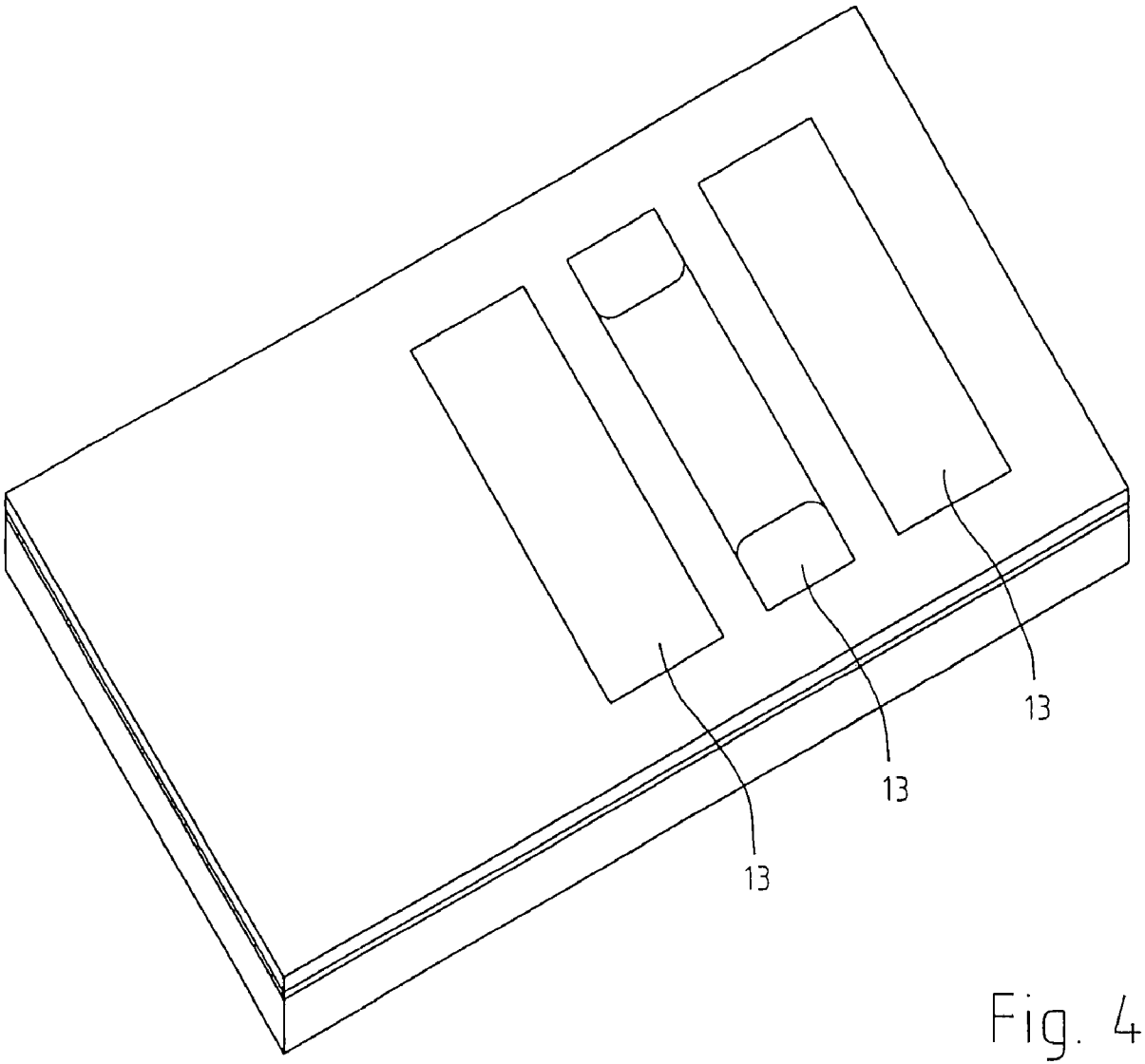
Figure 4H:
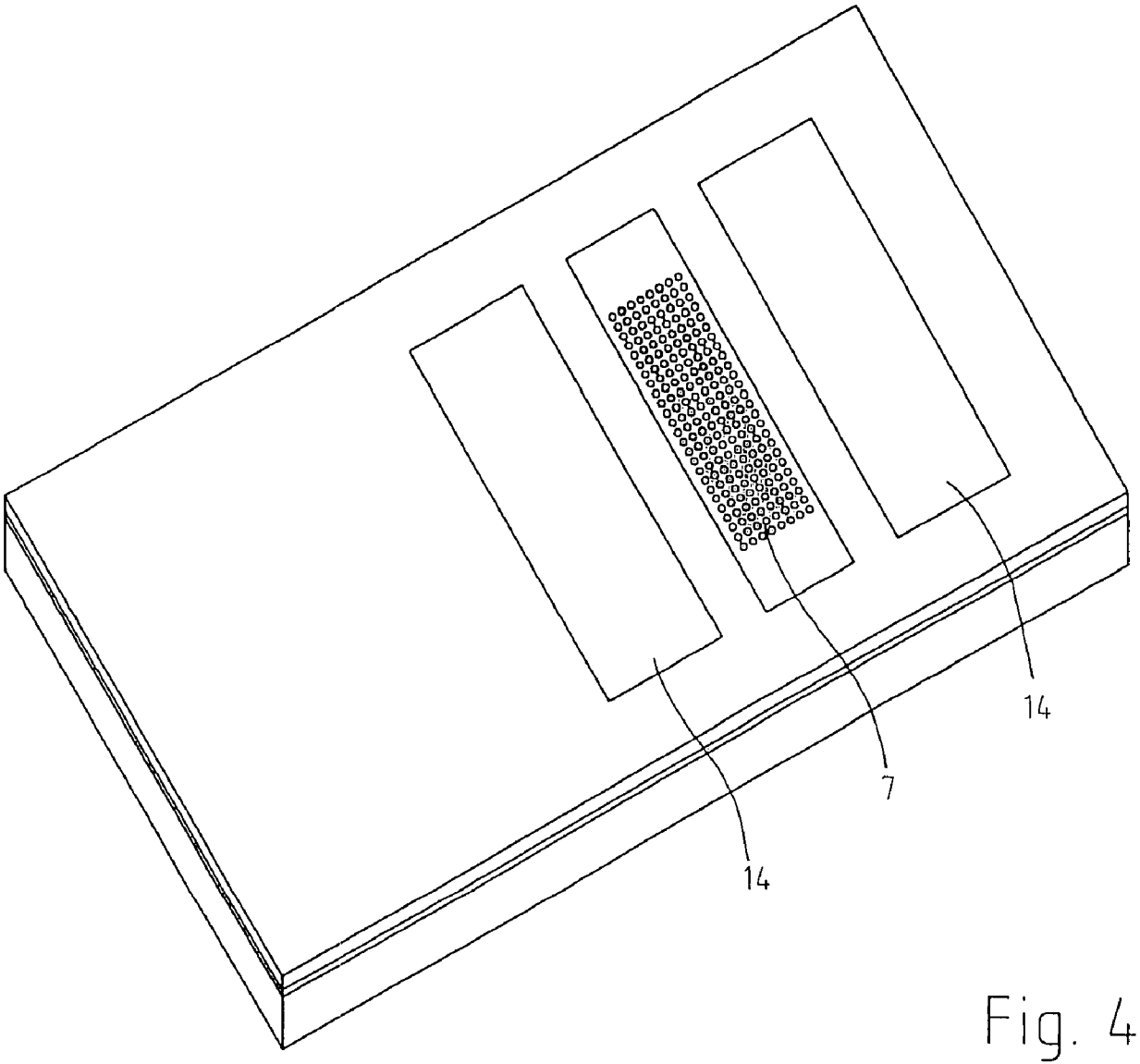

Next, there follows the generation of a sacrificial layer 45 and the corresponding patterning according to the structure of the intended grounding connectors 3, 4 and control line 5, the area above electrode 43 for forming the bridge also being covered. Photo-resist, for example, is suitable as sacrificial layer 45, at a thickness of 3.5 to 4 μm (FIG. 4*f*).

Layer 13 is then generated in an electroplating process. As the material for the electroplating process, copper, for instance, is suitable. This process step may be seen in FIG. 4*g*.

In a further process step (see FIG. 4*h*), cover layer 14 is generated, together with bridge 7. For this, for example, aluminum or aluminum-silicon-copper is applied at a thickness of 300 to 800 nm, and is patterned corresponding to the structures of grounding conductors 3, 4 and signal line 5. This means that bridge 7 continues as cover layer in the electroplated area of signal line 5.

Figure 4I:
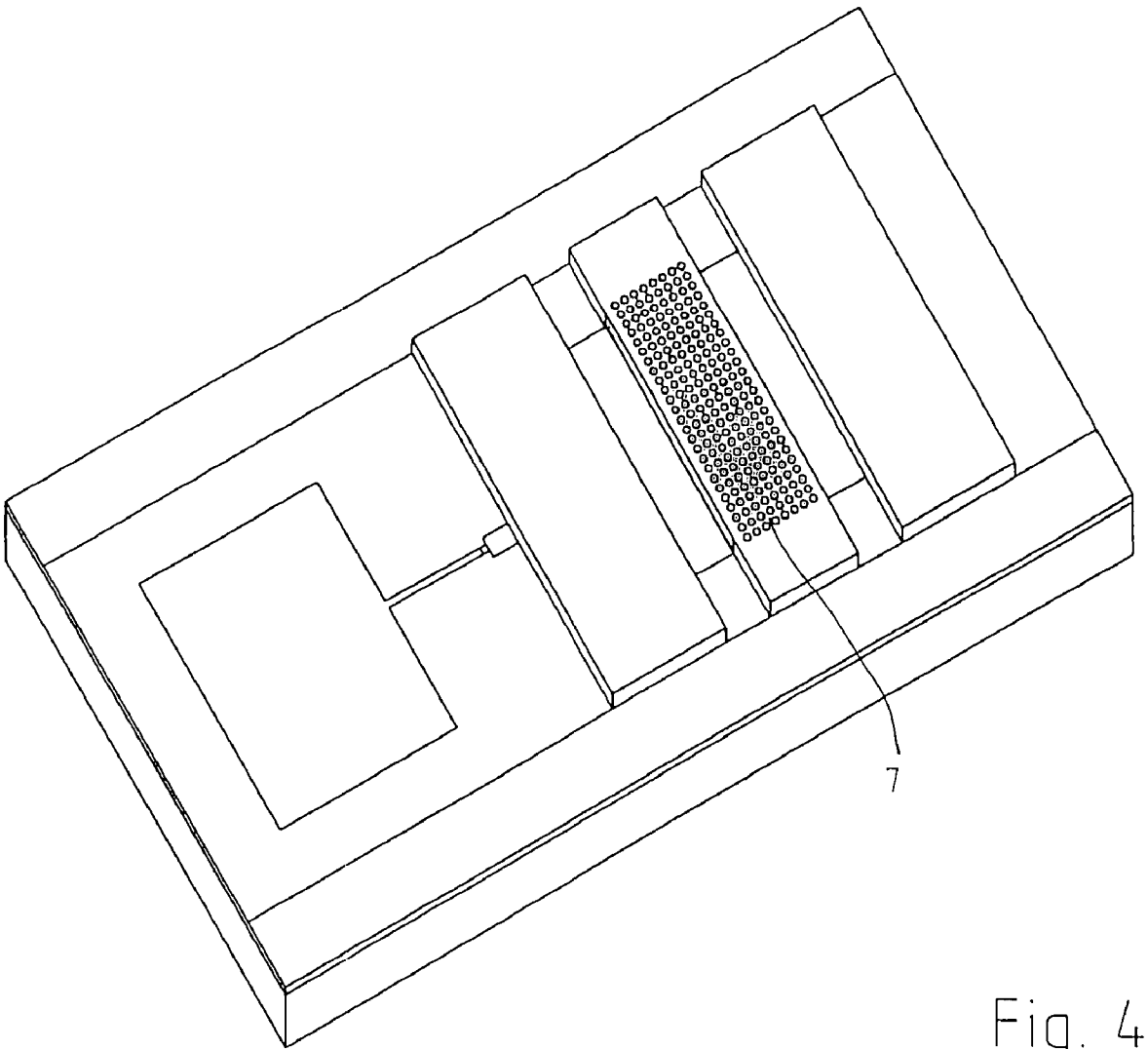

FIG. 4*i* shows that now sacrificial layer 45 is removed in an anisotropic etching step, such as by RIE $O_2$ plasma etching, except for the area under bridge 7.

Figure 4K:
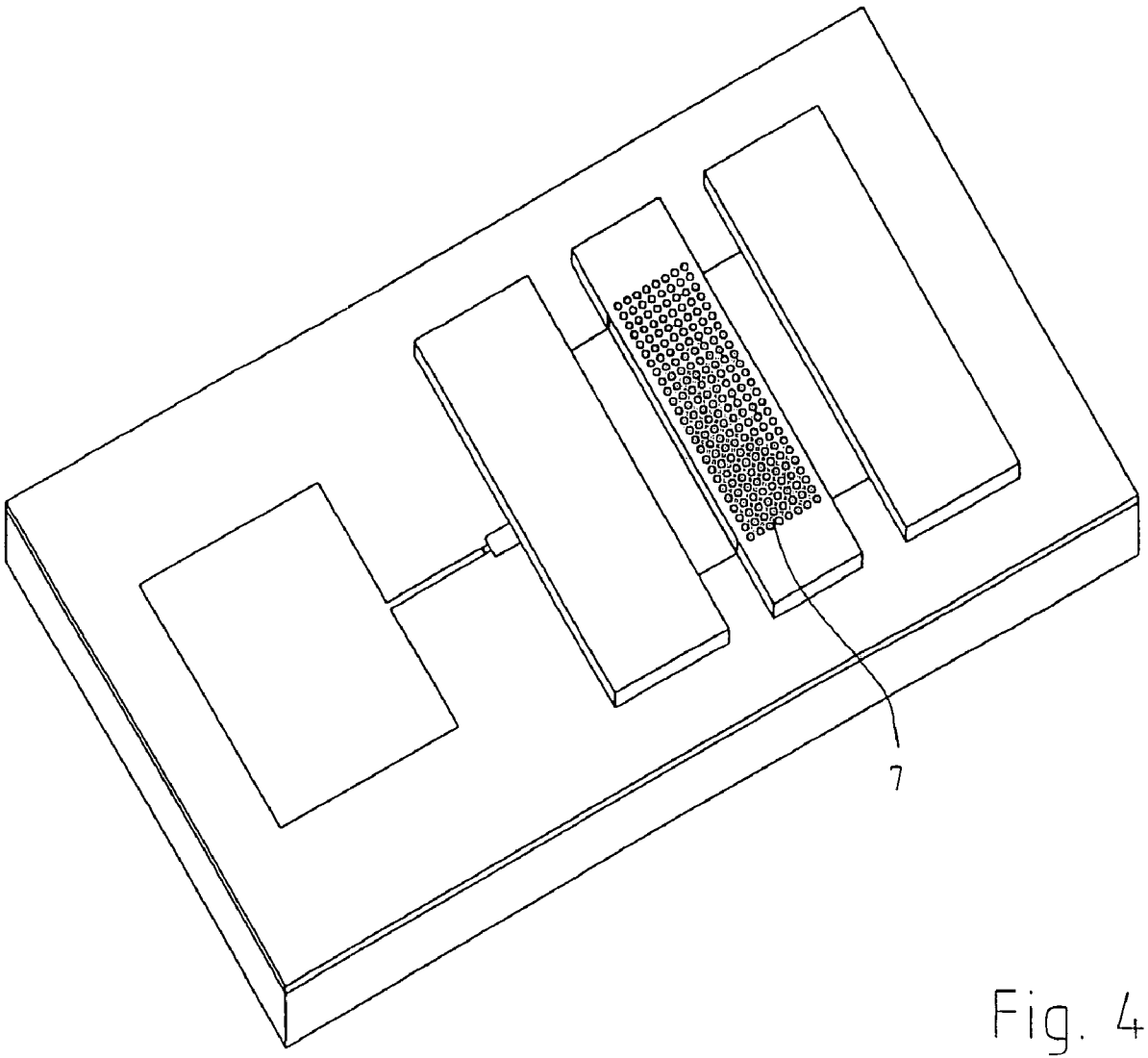
Figure 41:
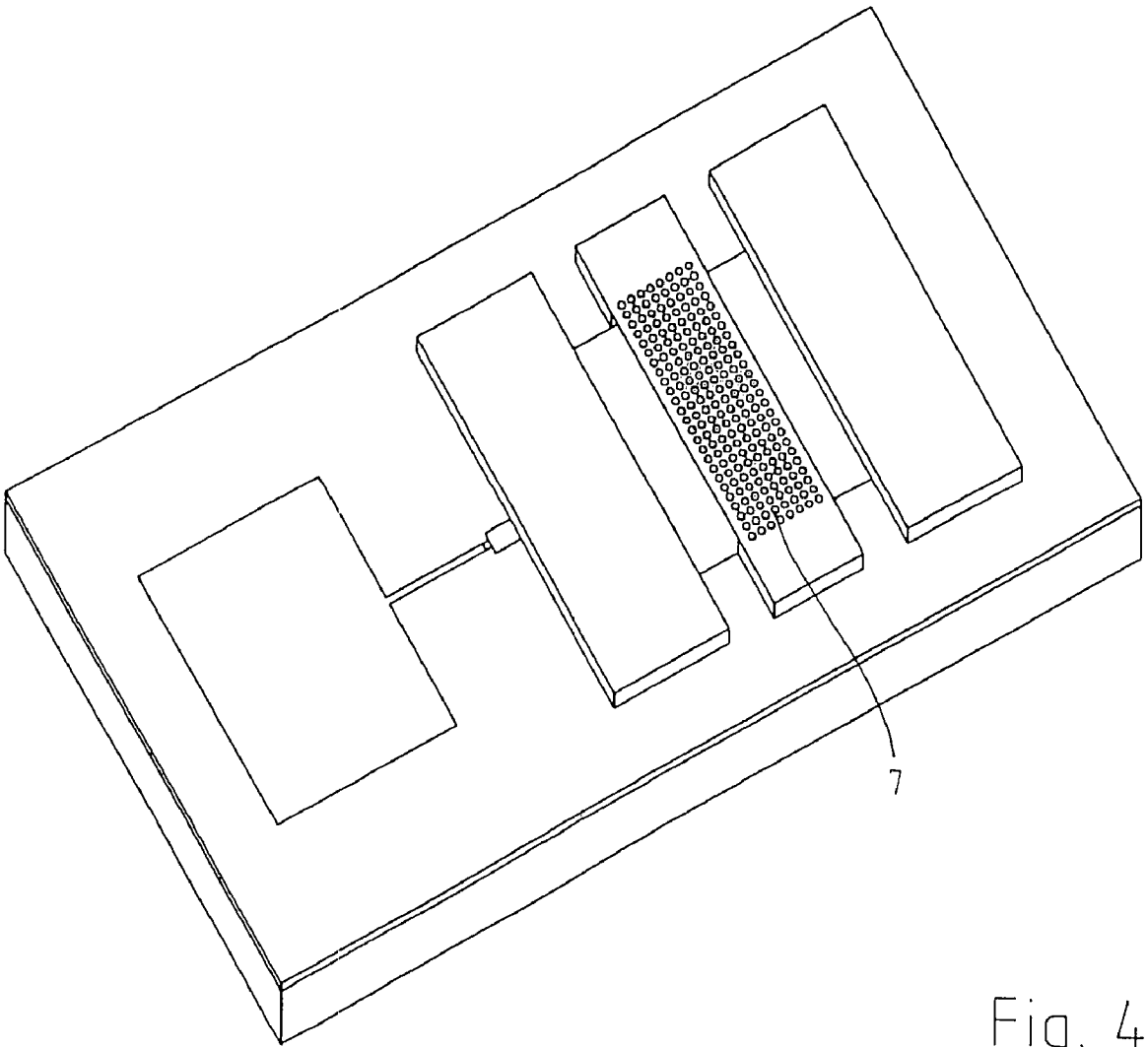

FIG. 4*k* shows the process state after which, selective with respect to all other metals, such as in hydrogen peroxide ($H_2O_2$), the molybdenum-tantalum of connecting bars 40 has been removed. By sacrificial layer 45 being still present under bridge 7, it is avoided that bridge 7 is affected by this process step.

As the next to last process step, sacrificial layer 45 is also removed from under bridge 7, whereby a structure according to FIG. 4*l* remains, which corresponds to the structure according to FIGS. 1*a* and 1*b*. Removing the sacrificial layer under bridge 7 requires an isotropic etching step which, for example, may be carried out in a plasma barrel etcher in $O_2$ plasma.

In comparison to other methods, critical planarization steps or differential etching steps are avoided by the method just described. In particular, the method described represents a solution of the "island problem":

In the production of phase shifters, surfaces are to be reinforced by electroplating, which, however, at the end of the production process are electrically insulated from other surfaces. But, for electroplating deposition, all surfaces must be connected to one another in a conductive manner. Therefore, it becomes necessary to remove again these connections in a step after the electroplating deposition. The present technological sequence permits the wet-chemical removal of these connection lines without destroying the micromechanical bridge.

What is claimed is:

1. A component for impedance change in a coplanar waveguide, comprising:

two grounding conductors;

a signal line lying between the grounding conductors;

a conducting connecting element, which has a covering area for the two grounding conductors and the signal line, and is electrically insulated, so that in each case a capacitor is developed;

wherein the connecting element and the grounding conductors and the signal line are situated so that a respective capacitor between the grounding conductors and the connecting element has an invariable capacitance, and a capacitor between the connecting element and the signal line has a variable capacitance.

2. The component of claim 1, wherein the respective capacitor between the grounding conductors and the connecting element has a variable capacitance, and the capacitor between the connecting element and the signal line has an invariable capacitance.

3. The component of claim 1, wherein the connecting element is mechanically deformable so that a distance between the connecting element and the line which, together with the connecting element, forms the variable capacitance, is variable in the area of the cover surface.

4. The component of claim 1, wherein the signal line or the grounding conductors in a subsection in which it covers the connecting element at a distance, is mechanically deformable so that the distance may be adjusted in an area of the covering surface.

5. The component of claim 1, wherein the connecting element is able to have a voltage applied to it.

6. A method for producing a component for impedance change in a coplanar waveguide, the method comprising:

depositing on a substrate at least one conductive layer for developing a connecting element and subsequently patterning it;

depositing an insulating layer on top of the conductive layer; and constructing, on the insulating layer, grounding conductors and a signal line having a bridge over the connecting element;

wherein the component includes:

the grounding conductors;

the signal line lying between the grounding conductors; and a conducting connecting element, which has a covering area for the grounding conductors and the signal line, and is electrically insulated, so that in each case a capacitor is developed, wherein the connecting element and the grounding conductors and the signal line are situated so that a respective capacitor between the grounding conductors and the connecting element has an invariable capacitance, and a capacitor between the connecting element and the signal line has a variable capacitance.

7. The method of claim 6, wherein another insulating layer is first applied onto the substrate.

8. The method of claim 6, wherein the insulating layer deposited on the connecting element is patterned.

9. The method of claim 6, wherein for the constructing of the grounding conductors and the signal line, a starting layer is first deposited.

10. The method of claim 6, wherein the starting layer is patterned.

11. The method of claim 6, wherein for the constructing of the lines having the bridge, a sacrificial layer is applied over the connecting element and is patterned.

12. The method of claim 11, wherein areas not covered by sacrificial layer, which have a starting layer, in an electroplating step for building-up the grounding conductors and the signal line, these areas are reinforced galvanically.

13. The method of claim 12, wherein for the constructing of the lines and the bridge, an additional metallization is placed over the layering and is patterned.

14. The method of claim 11, wherein the sacrificial layer is at least partially removed.

15. The method of claim 6, wherein connecting bars for an electroplating step are applied together with the connecting element, and, after anisotropically removing the sacrificial layer, they are also removed.

16. The method of claim 11, wherein the sacrificial layer is removed under the bridge metallization.

* * * * *